US006799702B1

(12) United States Patent
Mercer et al.

(10) Patent No.: US 6,799,702 B1
(45) Date of Patent: Oct. 5, 2004

(54) DEVICE FOR DISPENSING VISCOUS LIQUIDS

(75) Inventors: Jeff L. Mercer, Hendersonville, TN (US); James B. White, Nashville, TN (US)

(73) Assignee: GoPro, Inc., Hendersonville, TN (US)

( * ) Notice: Subject to any disclaimer, the term of this patent is extended or adjusted under 35 U.S.C. 154(b) by 215 days.

(21) Appl. No.: 09/990,213

(22) Filed: Nov. 21, 2001

Related U.S. Application Data

(60) Provisional application No. 60/252,738, filed on Nov. 22, 2000.

(51) Int. Cl.[7] ..... B67D 5/06

(52) U.S. Cl. ..... 222/189.06; 222/504; 137/549; 251/363

(58) Field of Search ..... 137/549; 251/363, 251/360; 222/189.06, 189.08, 504, 509, 518

(56) References Cited

U.S. PATENT DOCUMENTS

| | | | | | |
|---|---|---|---|---|---|
| 306,503 | A | * | 10/1884 | Maybury | 137/549 |
| 2,041,906 | A | * | 5/1936 | Czarnecki | 137/549 |
| 3,053,419 | A | * | 9/1962 | Palmer | 222/189.06 |
| 3,160,331 | A | * | 12/1964 | Trumbull et al. | 222/518 |
| 3,286,979 | A | * | 11/1966 | Brown et al. | 137/549 |
| 3,389,796 | A | * | 6/1968 | Fiala et al. | 137/549 |
| 3,815,788 | A | | 6/1974 | Reighard et al. | |
| 4,320,858 | A | | 3/1982 | Mercer et al. | |
| 4,465,212 | A | * | 8/1984 | Boone | 222/504 |
| 4,598,841 | A | | 7/1986 | Smiles | |
| 4,687,137 | A | | 8/1987 | Boger et al. | |
| 4,711,379 | A | * | 12/1987 | Price | 222/504 |
| 4,734,188 | A | | 3/1988 | Burdette, Jr. et al. | |
| 4,988,015 | A | * | 1/1991 | Price | 222/504 |
| 5,467,899 | A | * | 11/1995 | Miller | 222/504 |
| 5,589,226 | A | | 12/1996 | Geul | |
| 5,672,269 | A | | 9/1997 | White | |
| 5,683,578 | A | | 11/1997 | Zook et al. | |
| 5,715,972 | A | | 2/1998 | Siddiqui | |
| 5,720,417 | A | | 2/1998 | Wurth et al. | |
| 5,730,359 | A | | 3/1998 | Wujrth | |
| 5,823,437 | A | | 10/1998 | Bolyard, Jr. | |
| 5,873,528 | A | * | 2/1999 | Lewis et al. | 137/315.11 |
| 5,890,514 | A | | 4/1999 | Siddiqui | |
| 5,915,591 | A | | 6/1999 | Erickson et al. | |
| 5,924,607 | A | | 7/1999 | Yamada et al. | |
| 6,039,217 | A | | 3/2000 | Faulkner, III et al. | |
| 6,076,711 | A | | 6/2000 | McGuffey | |
| 6,082,627 | A | | 7/2000 | Raterman | |
| 6,105,832 | A | | 8/2000 | Beck | |

* cited by examiner

*Primary Examiner*—Kenneth Bomberg
(74) *Attorney, Agent, or Firm*—Waddey & Patterson; Mark J. Patterson

(57) ABSTRACT

A liquid dispensing device including a body generally having an air passage and a liquid passage. A valve seat is connected to the body and a valve stem is mounted for movement within the body with respect to the valve seat. A piston is caused to move by pressurized air, and is caused by a spring and optionally, air pressure above the piston, to return to its normal position when the air pressure is relieved. The stem is connected to the piston so that it is caused to move linearly to and from the valve seat. The stem is not rigidly connected to the piston, allowing the piston to find its center in the air cylinder and the stem to find its center in the liquid chamber. The piston is mounted with two bearing points so that it is not affected by uneven spring pressure. The stem is located by two bearing points, the adhesive seal and the seat. The air cylinder body and valve body are separated by a large open area. The body includes a user replaceable cylindrical filter disposed in the liquid chamber around the stem. This filter and the liquid seal is easily removed for maintenance by extracting the seal housing from the bottom of the valve.

11 Claims, 8 Drawing Sheets

DEVICE FOR DISPENSING VISCOUS LIQUIDS

APPLICATION FOR UNITED STATES LETTERS PATENT

Be it known that we, James B. White and Jeff L. Mercer, citizens of the United States, have invented a "Device for Dispensing Viscous Liquids."

This application claims benefit of co-pending U.S. patent application Ser. No. 60/252,738, filed Nov. 22, 2000, entitled "Valve for Dispensing Hot Melt Adhesive", the disclosure of which is incorporated herein by reference.

BACKGROUND OF THE INVENTION

This invention generally relates to devices used for dispensing viscous liquids such as hot melt adhesives and sealing compounds. Such devices may be referred to as fluid control valves or dispensing guns or modules. More specifically, the present invention relates to a valve for dispensing hot melt adhesives and other viscous liquids having improved features related to increasing reliability and performance while retaining the user's ability to adjust, repair and rebuild the device.

Hot melt adhesive systems are used in industry for applications ranging from automated product assembly to carton sealing. Thermoplastic adhesive is heated in and pumped from an adhesive supply unit. The adhesive is routed through a heat-traced hose to an application device. The application device often consists of a heated manifold and one or more valves with an application nozzle or a die. The valves start and stop the flow of adhesive to the nozzle and sometimes assist in metering the flow. Air pressure is commonly used to operate the valves.

Hot melt adhesive valves typically operate at temperatures up to 425° F. or 220° C. Adhesive pressure in the valve can be as high as 1200 psi. Air pressure in the air cylinders can be as high as 120 psi. Conventional valves supplied by most manufacturers will cycle about 3500 cycles per minute, with a response time of approximately 7 ms opening and 10 ms closing. The service life of currently available valves range from 5 million to about 40 million cycles.

A typical dispensing device for supplying liquid, such as hot melt adhesive, is shown in FIG. 1, and generally includes a valve body having a valve that opens and closes a dispensing orifice or die. The valve is usually operated by pressurized air to dispense discrete amounts of pressurized liquid. One or more liquid seals within the device prevent leakage or the migration of liquid between the liquid and air passages of the device. Liquid dispensing devices generally related to the present invention include a liquid passage adjacent to the dispensing orifice and an air passage or chamber at an opposite end of the device. The air passage contains a piston connected to a valve stem or needle on one side and may include a spring on the other side. Under sufficient air pressure, the piston and valve stem or needle may be moved in a direction away from the seat to dispense the liquid. When air pressure on the piston is relieved, the spring will return the stem to the normally closed position against the valve seat. Air pressure may also be used to assist in closing the valve stem assembly. These devices may include either a screw to adjust the stem/piston travel or the spring pressure, or both.

Despite the wide success of devices as described above, continuing problems exist. For example, the valve stem may be over supported against sideward movement and this may lead to increased wear of the various seals used around the stem due to indeterminate side forces. Also, typical dispensing modules have included a rigidly connected or integrally formed flange on the end of the stem bearing against the return spring. This increases the possibility that a side load is exerted on the stem by the spring and, again, this may lead to increased seal wear.

Another problem associated with dispensing hot melt adhesives is the abrasive nature of contaminants that are contained in the liquid when it is delivered to the dispensing device or that are generated internally in the device. Filters are used in the prior art in an attempt to remove contaminants from the liquid but these filters are typically located in the manifold, upstream from the dispensing device. These manifold filters often contain insufficient filter area to be effective when the manifold is supplying liquid to multiple dispensing modules. Manifold filters also do not address the problems caused by char and other contaminants generated internally in the dispensing device which can damage the valve and clog the nozzle if not trapped, leading to frequent failure of the dispensing device.

Another failure mode associated with prior art hot melt dispensing devices is caused by thermal transfer and adhesive migration from the liquid valve to the air cylinder. As seen in FIG. 1, conventional dispensing modules are configured with substantial direct contact between the air cylinder body and the valve body, including in the region proximate the piston and valve stem. This facilitates undesirable transfer of leaking adhesive and destructive heat from the valve into the air cylinder seals.

Yet another deficiency associated with prior art liquid dispensing devices is the down time caused by replacement of internal valve seals. Conventional dispensing modules use liquid seals that must be replaced periodically, usually requiring complete removal and either replacement or disassembly of the entire module. This is a time consuming, labor intensive process.

It would be desirable to provide a liquid dispensing device that may be readily substituted within applications currently utilizing existing dispensing devices or modules, but having various improvements eliminating or reducing problems such as those mentioned above.

SUMMARY OF THE INVENTION

An object of the present invention is to provide a device for dispensing hot melt adhesives and other viscous liquids that can operate for extended periods with fewer failures caused by contaminants, heat, and internal wear.

Another object of the invention is to provide means internal to the dispensing device for filtering contaminants in the liquid.

A further object of the invention is provide a liquid dispensing device that mitigates the effects of heat and liquid transfer from the valve body to the air cylinder.

Yet another object of the invention is to reduce operational downtime arising from maintenance of the seals and other internal valve components.

The present invention therefore generally provides a liquid dispensing device having a valve body with a liquid passage. A valve element having a valve seat and a dispensing orifice is operatively connected with the body. A stem is mounted for movement within the body to open and close the dispensing orifice. In accordance with the invention, the stem is mounted so that it can find its own center in the fluid chamber. The stem adopts a center due to the influence of the seal and the seat. In making the seal one of the only two bearing points against the stem, the side forces on the seal are minimal, and the wear on the seal is also minimal. The liquid seal is preferably formed from Celazole PBI as this material is the strongest and highest temperature stable plastic available. Sharp edges, useful for scraping high viscosity liquid from the stem, are machined into this material. This material is very hard, and can be abrasive to most metals. Accordingly the stem is preferably made of nickel bonded tungsten carbide, one of the hardest acid resistant materials available.

The stem and piston are connected to a spring return mechanism including a return spring for maintaining the stem in a normally closed position. In a preferred embodiment, air pressure may alternatively or additionally be used to maintain the stem in a closed position. The piston is designed to translate this force into a linear-only force. The piston has two bearing points and does not depend on the stem for location. The piston uses floating piston dynamic seal design. This allows the piston to float in the cylinder to minimize friction losses that would slow the speed or response time. The piston does not benefit from or depend on the presence of a stem for radial location in the air cylinder.

Production methods favoring machining from one side of the valve block involve compromises. The air and liquid section must be separated by a cartridge (sometimes called a spool). This design can leak liquid into the air chamber. Top machining limits the variety of applicator devices that can be connected to the valve. Bottom machining limits the diameter of the air cylinder that is critical to linear force. A valve that is useful in a wide range of applications has a bolt pattern on the bottom that supports the greatest number of application attachments. The present invention is machined from both ends with a large separation notch to physically separate the two sections. This notch reduces the chance that liquid will find its way into the air chamber. This notch also reduces the heat transfer from the liquid (hot melt adhesive) section to the air section which will increase air seal life. The notch provides high visibility of the stem and piston to help in troubleshooting. This device has a bottom-mounting pattern that is consistent with the most versatile devices in the industry. Although designed as a metric device, some even inch dimensions are used to insure interchangeability with current industry devices.

Another aspect of the invention is a filter disposed as a cylinder around the stem in the liquid chamber. This filter is the final filter for removing contaminants or degraded adhesive that may make it into the area around the stem and into the critical areas in the liquid seal/stem/seat and the nozzle. The filter is appropriate in this location because liquid flow is most often proportional to the number of modules. The filter is easily changeable by the user. Different filter mesh is available to match the characteristics of the liquid (viscosity or amount of contaminates) and the output orifice size.

In accordance with another feature of the invention, the internal filter and liquid seal assemblies are easily removable from the bottom of the dispensing device for maintenance.

BRIEF DESCRIPTION OF THE DRAWINGS

FIG. 5(*b*) is a cross-sectional view of the valve stem and piston assembly of FIG. 5(*a*).

FIG. 5(*c*) is an enlarged cross-sectional view of a portion of the valve stem and piston assembly, showing another embodiment of the stem retaining means.

DETAILED DESCRIPTION OF THE PREFERRED EMBODIMENTS

Figure 1:
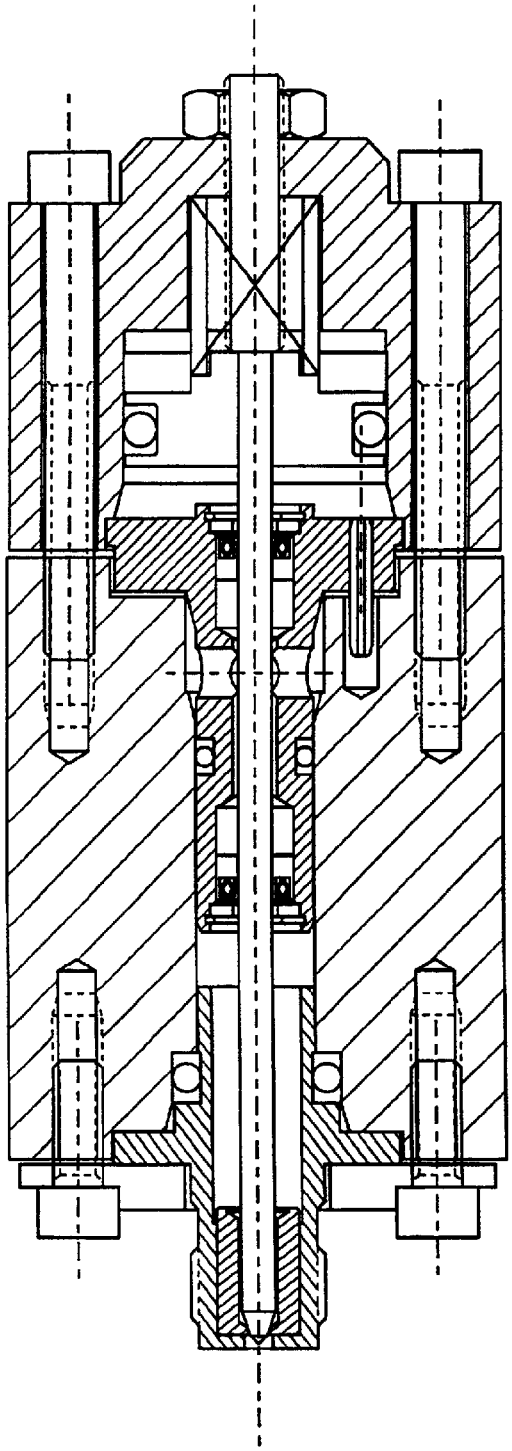
FIG. 1 (Prior Art)
FIG. 1 is a sectional view taken thru the bolts of a typical prior art hot melt adhesive valve device.
Figure 2:
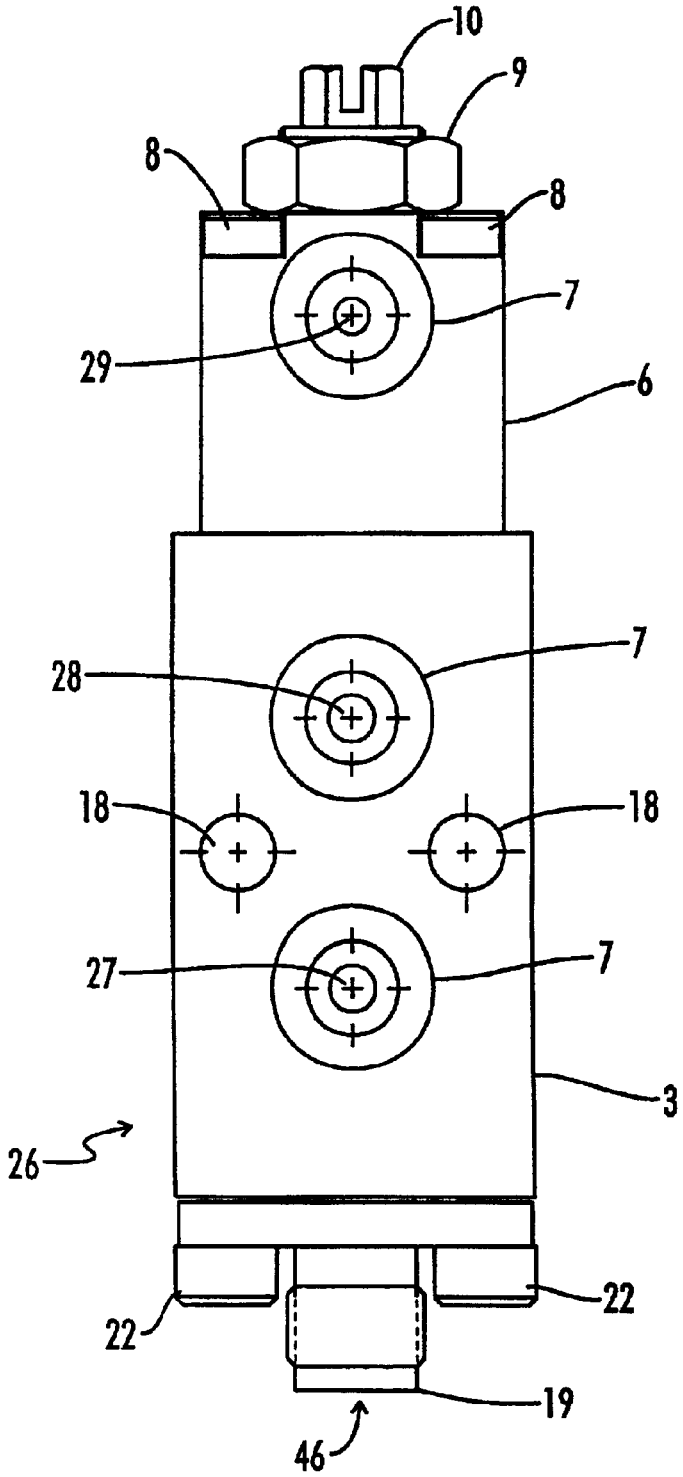
FIG. 2 is a rear view of a liquid dispensing device constructed in accordance with one embodiment of the present invention.
Figure 3:
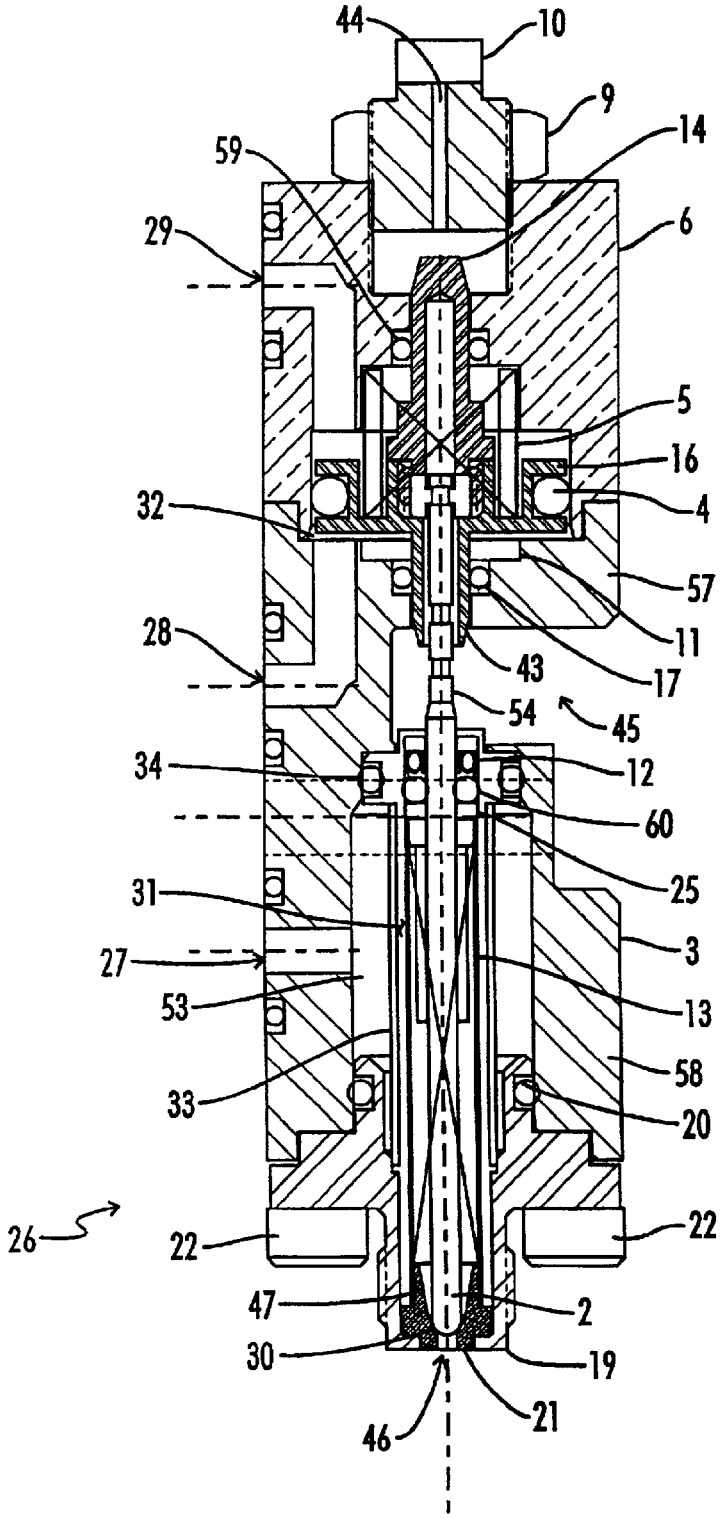
FIG. 3 is a side sectional view taken through the center of the device of FIG. 2.
Figure 4:
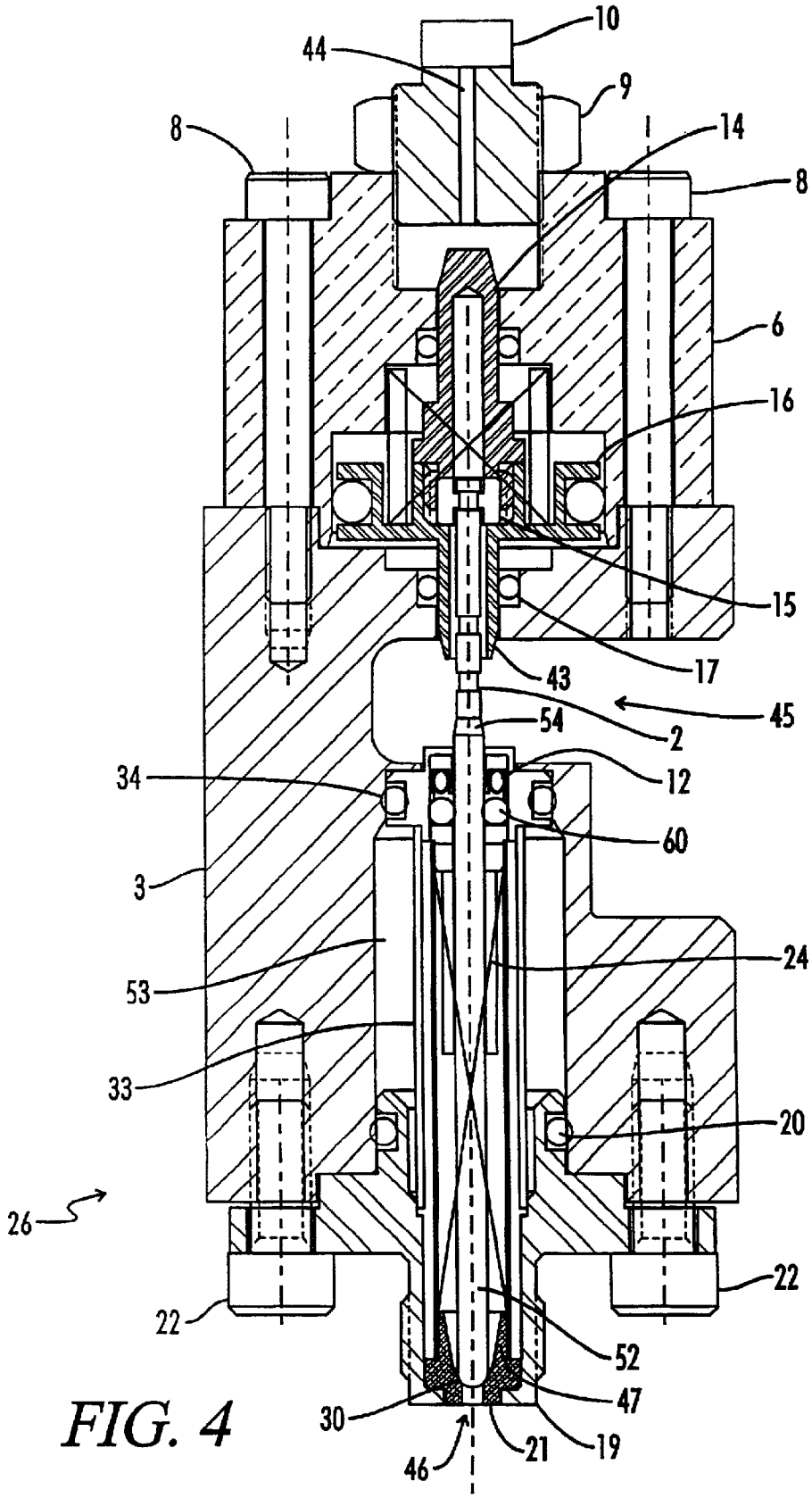
FIG. 4 is a sectional view taken through the bolts 8 and 22 of the device of FIGS. 2 and 3.

Referring to FIGS. 2–4, a liquid dispensing device 26 is shown as an embodiment particularly adapted for dispensing of thermoplastic ("hot melt") adhesive, in combination with conventional adhesive manifold and air systems (not shown) for extended rapid cycle manufacturing operations. The device 26, sometimes referred to as a hot melt adhesive valve module, includes a valve body 3 attached to an air cylinder body 6 using four screws 8 (FIG. 4). A nozzle adapter 19 is also mechanically attached to the valve body 3 using four screws 22, the nozzle adapter 19 received by a recessed bore in the housing 3 and sealed by an O-ring 20, as shown in FIGS. 3 and 4. A valve seat 21 is pressed into the nozzle adapter 19, the seat 21 having a dispensing orifice 46. A valve stem 2 is mounted for reciprocating vertical movement within a liquid chamber 53 internal to valve body 3. A lower section 52 of stem 2 forms a valve with a forced contact with the seat 21 at the shutoff point 30 to permit or restrict flow of liquid through the dispensing orifice 46. The valve body 3 is preferably formed from 303 stainless steel. The body 3 includes two fastener holes 18 as shown in FIG. 2.

The valve seat 21 and stem 2 are preferably formed from nickel bonded tungsten carbide. The nozzle adapter can be made from CDA360 brass with nickel plating. The valve seat 21 may be formed as an integral part of the nozzle adapter 19. The nozzle adapter 19 may include external threads allowing the attachment of a desired dispensing nozzle (not shown).

As shown best in FIG. 3, the valve body 3 includes a liquid passage 27 and a valve-opening air passage 28. The liquid passage 27 extends laterally from liquid chamber 53 through the body 3. The opening air passage 28 connects to an air chamber 32 under a piston 16. The air chamber 32 is formed when the air cylinder body 6 is mechanically attached to the valve body 3. A valve closing air passage 29 communicates with the air chamber 32 through the air cylinder body 6. Liquid and air are introduced to the device 26 from a manifold (not shown) having ports and fastener locations that allow the device to be mounted to the manifold. As seen on FIG. 2, O-rings 7 are disposed about the entry ports to passages 27, 28, and 29 in recesses that interfere slightly with the outer diameter of the O-rings.

Figure 5A:
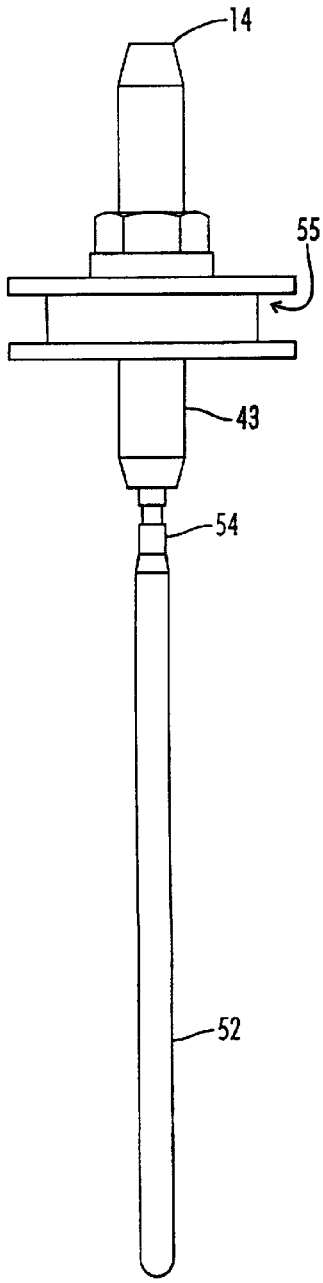
FIG. 5(*a*) is a side view of a valve stem and piston assembly used in a preferred embodiment of the invention.
Figure 5B:
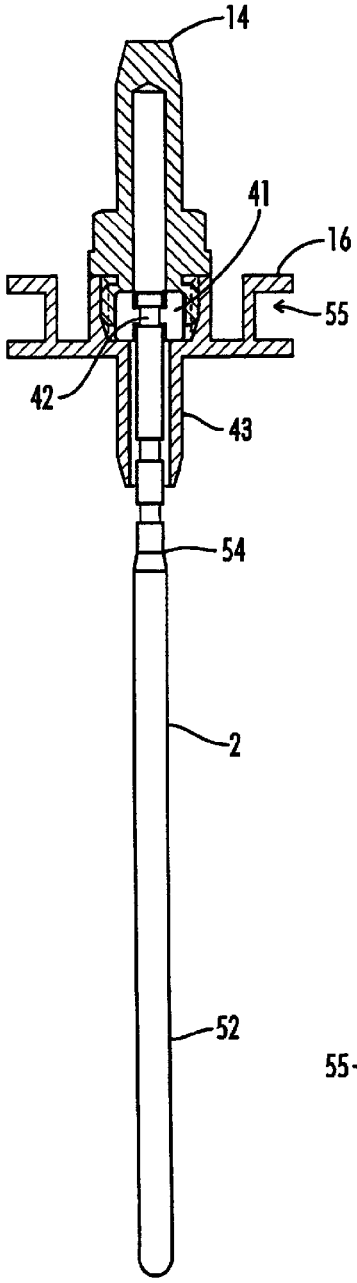
Figure 5C:
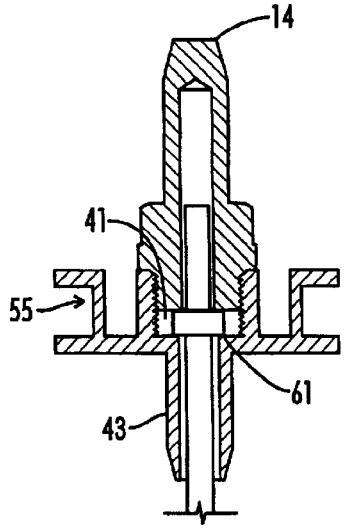

The piston assembly as shown in FIG. 5 includes a piston 16, a cap 14, lock 15, and the stem 2. The lock 15 is captured in a cavity 41 formed by the joining the piston 16 and the screw-on cap 14. In one embodiment, the lock 15 is a separate piece formed from heat-treated tool steel. A lower section 43 of the piston receives a portion of the upper section 54 of stem 2. The lock 15 engages a groove 42 in the upper section 54 of stem 2 so that as the piston 16 moves in the direction of its centerline it causes the stem 2 to move in that direction. The lock 15 does not require that the piston 16 and the stem 2 adopt the same centerline. Thus, the lower section 52 of valve stem 2 is vertically aligned inside the liquid chamber 53 by the valve seat 21 and seal 12. The lock 15 acts as stem retaining means to mechanically engage the upper section 54 of the stem 2 to allow angular pivoting of the central axis of the stem 2 in response to lateral forces applied to the lower section 52 of the stem 2 during operation of the device 26. As an alternative to using a separate lock to provide a pivoting or floating engagement and retention of the stem 2 within the cavity 41 of the piston 16, a shoulder 61 can be formed on the upper section 54 of the stem, as shown in FIG. 5(*c*).

As shown in FIGS. 3 and 4, the piston assembly is located in recessed bores in the air cylinder body 6 and in the valve body 3 by the cap 14 and by the lower extension 43 of the piston 16. A valve spring 5 (FIG. 3) biases the piston 16 downward, providing a normally closed position of the valve stem 2 with respect to the valve seat 21.

As shown in FIG. 5, the piston 16 has a circumferential groove 55 to support a cylinder seal 4 (FIG. 3). This seal 4 is preferably a fluorocarbon O-ring or a spring-loaded polymer piston ring. The lower extension 43 of the piston 16 is sealed with an O-ring 17 (FIG. 3). The piston 16 is mounted with two bearing points (Seal 4 and O-ring 17) so that the piston is not affected by uneven spring pressure. This configuration allows the piston 16 to "float" in the air chamber 32 to minimize frictional contact that might reduce the valve speed and response time. Accordingly, the air chamber 32 can be pressurized, causing the piston 16 to move vertically, compressing the valve spring 5 and lifting the stem 2 away from the seat 21. This will allow liquid to flow through the seat 21 and adapter housing 19, and through the dispensing orifice 46 into the application device or nozzle (not shown). The travel of the piston 16 and stem 2 can be limited by a travel stop screw 10 (FIG. 2), which is attached at the top of air cylinder body 6 and locked in position by a hex nut 9 (FIG. 2). The travel stop screw 10 has a hole 44 (FIG. 4) through its centerline through which a probe (not shown) can be inserted to measure the travel of piston 16. The travel stop screw 10 is preferably formed from 440c stainless steel, and the hex nut 9 is formed of 303 stainless steel. Preferably, stem travel is directly adjustable through a range of 0.25 mm to 2 mm, with a nominal setting of 1 mm.

The spring 5 is the primary device to close the valve by moving the piston 16 and stem 2 to engage the seat 21. The spring 5 is formed from 17-4 stainless steel. Optionally, closing air can be provided through air passage 29 to assist the spring 5 in more firmly seating the stem 2 against the seat 21. When closing air is used, an additional O-ring 59 seals the piston cap 14 as it passes through the air cylinder body 6 (FIG. 3).

Figure 6:
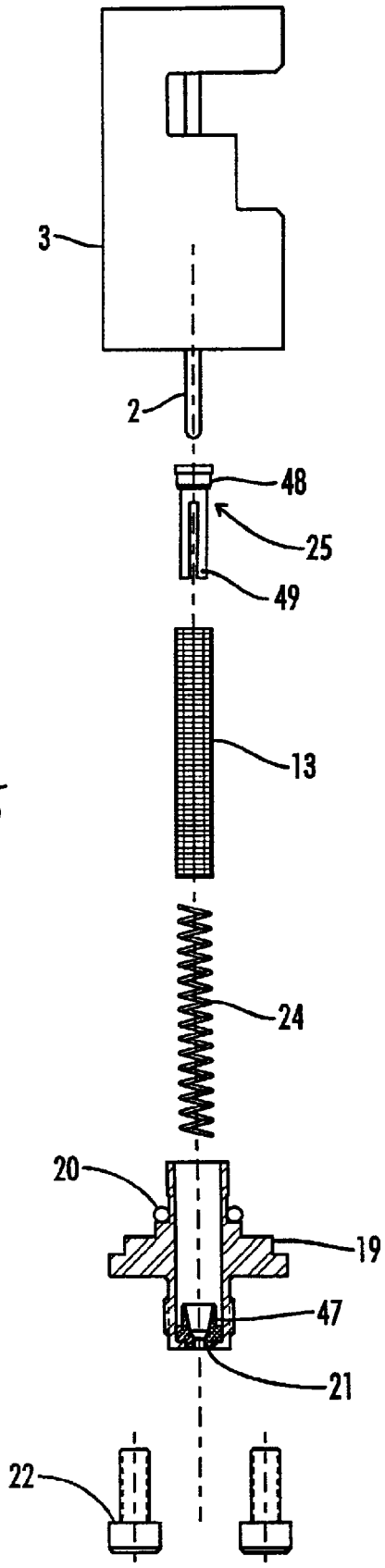
FIG. 6 is an exploded sectional view of the filter components used in a preferred embodiment of the invention.

In accordance with another aspect of the invention, the liquid dispensing device 26 includes an internal filter for capturing contaminants that enter the device 26 in the liquid or that may be generated internally in some valves. FIG. 6 shows the components that comprise the filter assembly. The bottom portion of a filter element 13 fits snugly in a sealing engagement over a vertically extending upper portion 47 of the seat 21. In a preferred embodiment, the filter 13 is a wire mesh cylinder. Accordingly, a spring 24 may be positioned inside the filter 13 as an internal support to prevent filter collapse due to pressure differentials within the liquid chamber 53. An annular cap 25, preferably formed of PTFE, includes a smaller diameter lower section 49 that is internal to filter element and a larger diameter uppers section 48 that is external to and contacts the top of the filter element 13. A cylindrical opening extends through the cap 25 to receive the valve stem 2. Thus, cap 25 seals the top of the filter 13, and provides a suitable interface between the filter 13 and a liquid seal 12 to prevent contaminates from enter the seal area, as shown in FIGS. 3 and 4.

Figure 7:
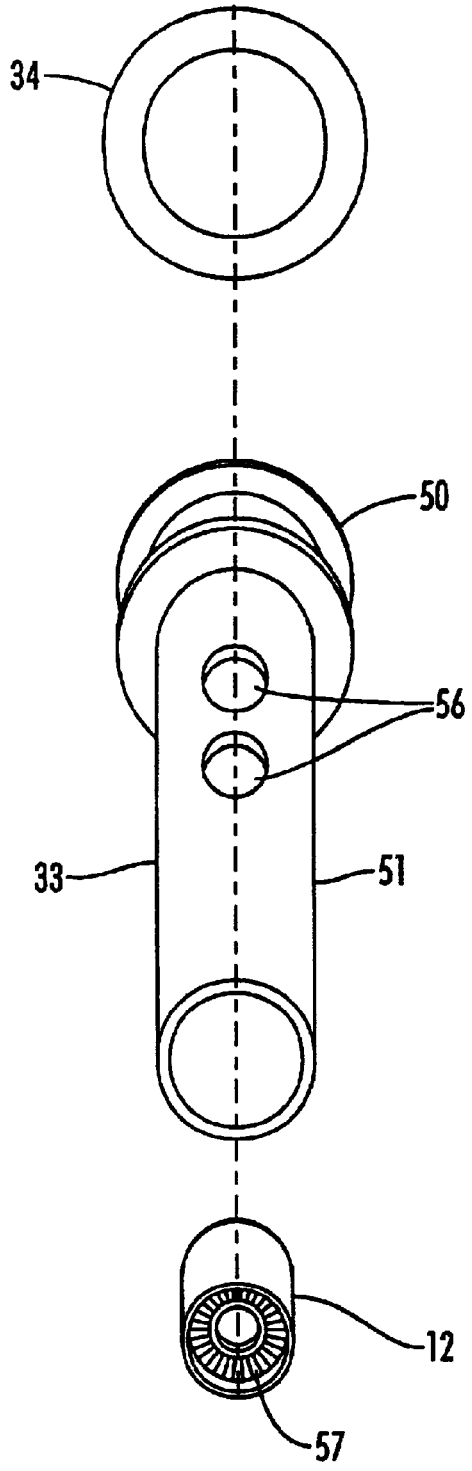
FIG. 7 is an exploded isometric view of the liquid seal and filter body assembly used in a preferred embodiment of the invention.

As shown in FIGS. 4 and 7, the liquid seal 12 is disposed about the stem 2 and within a cylindrical housing 33, inside the valve body 3. The housing 33 has a lower section 51 (FIG. 7) extending through the liquid chamber 53 and partially into the nozzle adapter 19 and an upper section 50 positioned proximate the top or upper opening of the liquid chamber 53. The lower section 51 and upper section 50 may be formed as a single piece or press fit assembly. An O-ring 34 is positioned around the upper section 50 of the housing 33 seals the upper end of the liquid chamber 53 (FIG. 3). As best seen in FIG. 3, the housing 33 also encloses the filter element 13 and has one or more openings 56 through the lower section 51 to provide liquid communication between the liquid chamber 53 and the filter element 13. Accordingly, hot melt adhesive or other liquid can enter the liquid chamber 53 through liquid passage 27, pass through openings 56 in the housing 33 and then move radially through the filter element 13 before being dispensed from the device 26 through the orifice 46.

As shown in FIG. 7, the liquid seal 12 has a generally 'U' or 'J' shaped cross-section, as is known to those of skill in the art. The seal 12 is loaded against the body 3 and the stem 2 with a coil spring 57 (FIG. 7) and has sharp scraping edges to bear against the stem 2. Preferably, the seal 12 is formed of Celazole PBI, a high temperature material that may be machined with the optimally sharp edge. Optionally, other seal components 60 (FIG. 3) may be used to enhance sealing for unusual liquids, temperatures, or viscosities.

In the event that maintenance of the filter 13 or seal 12 is required, the nozzle adapter 19 can be detached from the valve body 3 by removing screws 22. The housing 33, filter components 25, 13, and 24, and seal 12 can then be easily removed from the device 26 through the exposed bottom opening of the liquid chamber 53.

As can be seen in FIGS. 3 and 4, alignment of the stem 2 is provided at only two points within the device 26, i.e., at the seal 12 and at the valve seat 21. By limiting the stem bearing points, and by allowing the stem 2 to align itself within these bearing points independently of the center axis of the piston 16, side forces and wear on the stem 2 are reduced.

Figure 8A:
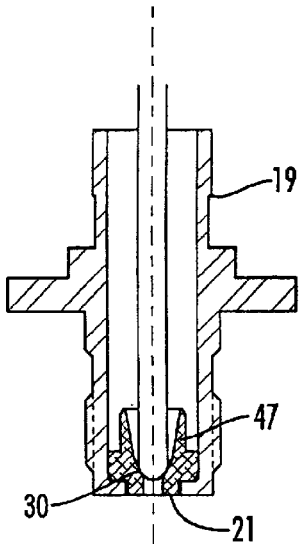
FIGS. 8A, 8B, and 8C are sectional views, taken through the valve seat, showing three different embodiments of the valve seat positioned inside a nozzle adapter, as used in a preferred embodiment of the invention.
Figure 8B:
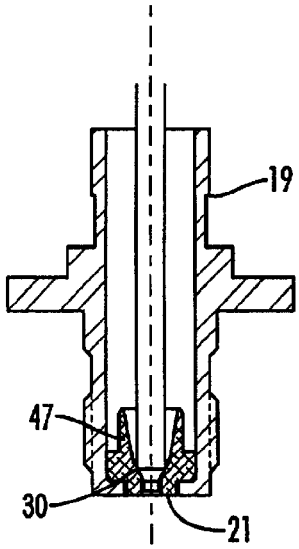
Figure 8C:
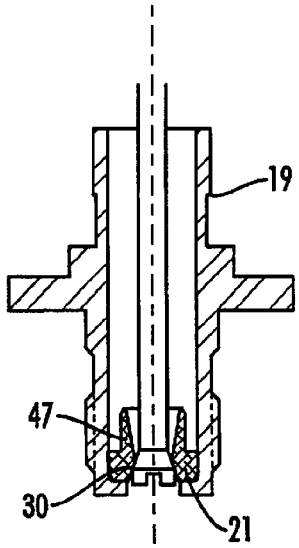

As shown in FIGS. 3 and 4, a preferred embodiment of the valve body 3 has an upper section 57 partially separated from a lower section 58 by a notched portion 45 above the upper opening of the liquid chamber 53. The thermal and mechanical isolation provided by the notched portion 45 restricts undesirable transfer of heat from the valve body 3 to the air cylinder body 6. If leakage of liquid occurs, the notch 45 reduces the chance of liquid contacting the air seal 17. As shown in FIGS. 8A, 8B, and 8C, the geometries of the lower section 52 of stem 2 and of the seat 21 can vary for different applications. For example, "push to shut off" valve designs use a seat with two successive frustoconical surfaces. The end of stem 2 may have a spherical radius as shown in FIG. 8A. FIG. 8B shows an embodiment where the stem 2 is designed to fill as much of the down stream cavity (dispending orifice 46) as possible. This is known in the industry as reduced cavity and it is used when reduced stringing is a higher priority than accurate liquid placement. FIG. 8C shows a version that is called a poppet valve. This design is sometimes used when crisp shut-off of flow is a higher priority than a high cycle rate.

Thus, although there have been described particular embodiments of the present invention of a new and useful Device for Dispensing Viscous Liquids, it is not intended that such references be construed as limitations upon the scope of this invention except as set forth in the following claims.

What is claimed is:

1. A device for dispensing a liquid comprising:

a. a valve body having a liquid chamber including a lower chamber opening and an upper chamber opening, and a liquid passage extending through the valve body to the chamber, b. a valve assembly including a valve seat forming a sealing relationship with the lower chamber opening, the valve seat having a dispensing orifice, and a valve stem extending vertically through the upper chamber opening proximate a seal area and operative to open and close the dispensing orifice;

c. a replaceable filter assembly disposed in the liquid chamber around the valve stem, the filter assembly including a filter element positioned between the liquid passage and the valve seat so that liquid entering the device must pass through the filter assembly before the liquid is dispensed; and d. the filter assembly further comprising a liquid sealing element sealing a top portion of the filter assembly so that contaminants in the liquid cannot enter the seal area proximate the upper chamber opening.

2. The device of claim 1 wherein:

a. the filter element comprises a cylindrical filter element having a bottom portion in a sealing engagement with a vertically extending upper portion of the valve seat; and b. the liquid passage extends away from the chamber through the valve body to provide a radial flow of the liquid into the filter element.

3. The device of claim 2, the filter assembly further comprising a filter support internal to the filter element.

4. A device for dispensing a liquid comprising:

a. a valve body having a liquid chamber including a lower chamber opening, and a liquid passage extending through the valve body to the chamber, b. a valve assembly including a valve seat forming a sealing relationship with the lower chamber opening, the valve seat having a dispensing orifice, and a valve stem extending vertically through the chamber and operative to open and close the dispensing orifice;

c. a replaceable filter assembly disposed in the liquid chamber around the valve stem, the filter assembly positioned between the liquid passage and the valve seat so that liquid entering the device must pass through the filter assembly before the liquid is dispensed;

d. the filter assembly comprises a cylindrical filter element having a bottom portion in a sealing engagement with an upper portion of the valve seat;

e. the liquid passage extends away from the chamber through the valve body to provide a radial flow of the liquid into the filter element;

f. the filter assembly further comprising a filter support internal to the filter element; and g. wherein the filter support comprises a spring.

5. The device of claim 4 further comprising a liquid sealing element positioned within the valve body proximate an upper portion of the filter element.

6. The device of claim 5, the filter assembly further comprising an annular filter cap having a smaller diameter lower section internal to the filter element and a larger diameter upper section external to and contacting the upper portion of the filter element, the filter cap further comprising a cylindrical opening extending through the cap to receive the valve stem.

7. The device of claim 6 further comprising a nozzle adapter removably attached to the valve body, the nozzle adapter internally receiving the valve seat and positioned to provide a sealing engagement with the lower chamber opening, whereby the filter element can be removed and replaced through the lower chamber opening when the nozzle adapter is detached from the valve body.

8. The device of claim 7 further comprising a cylindrical housing having a lower section extending through the liquid chamber and partially into the nozzle adapter and an upper section positioned proximate an upper opening of the liquid chamber, the housing enclosing the filter element and having at least one opening through the lower section to provide liquid communication between the liquid chamber and the filter element.

9. The device of claim 8 further comprising an air cylinder attached to the valve body, the air cylinder including an internal piston engaging an upper portion of the valve stem and operative to provide reciprocating vertical movement of the stem within the liquid chamber to open and close the dispensing orifice.

10. A liquid dispensing device comprising:

a. valve assembly comprising a valve body, a liquid chamber inside the valve body, and a liquid passage into the liquid chamber, the liquid chamber having an upper opening and a lower opening;

b. a nozzle adapter removably attached to the valve body proximate the lower opening of the liquid chamber, c. a valve seat retained by the nozzle adapter proximate the lower opening of the liquid chamber, the valve seat including a dispensing orifice in liquid communication with the liquid chamber;

d. a valve stem having a lower section vertically aligned within the liquid chamber and an upper section extending through the upper opening of the liquid chamber, the valve stem adapted for vertical reciprocating movement to open and close the dispensing orifice;

e. a seal assembly comprising at least one liquid seal engaging the valve body proximate the upper opening of the liquid chamber, the liquid seal having a central bore providing a reciprocating sealing contact with the valve stem, a housing vertically aligned and slidably retained within the liquid chamber, the housing having an internal bore surrounding and retaining the liquid seal; and f. wherein the seal assembly is removable as a unit through the lower opening of the liquid chamber when the nozzle adapter is detached from the valve body.

11. A liquid dispensing device comprising:

a. valve assembly comprising a valve body, a liquid chamber inside the valve body, and a liquid passage into the liquid chamber, the liquid chamber having an upper opening and a lower opening;

b. a nozzle adapter removably attached to the valve body proximate the lower opening of the liquid chamber, c. a valve seat retained by the nozzle adapter proximate the lower opening of the liquid chamber, the valve seat including a dispensing orifice in liquid communication with the liquid chamber;

d. a valve stem having a lower section vertically aligned within the liquid chamber and an upper section extending through the upper opening of the liquid chamber, the valve stem adapted for vertical reciprocating movement to open and close the dispensing orifice;

e. a seal assembly comprising at least one liquid seal engaging the valve body proximate the upper opening of the liquid chamber, the liquid seal having a central bore providing a reciprocating sealing contact with the valve stem, a housing vertically aligned and slidably retained within the liquid chamber, the housing having an internal bore surrounding and retaining the liquid seal;

f. wherein the seal assembly is removable as a unit through the lower opening of the liquid chamber when the nozzle adapter is detached from the valve body;

wherein the housing comprises a lower section extending through the liquid chamber and partially into the nozzle adaptor, an annular upper section positioned to provide a sealing engagement with the valve body proximate the upper opening of the liquid chamber, and h. the seal assembly further comprises an O-ring positioned around the upper section of the housing.

* * * * *